United States Patent [19]

Jeschke

[11] Patent Number: 5,020,432

[45] Date of Patent: Jun. 4, 1991

[54] DEVICE FOR METERING INK IN OFFSET PRINTING PRESSES

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 485,816

[22] Filed: Feb. 26, 1990

Related U.S. Application Data

[60] Continuation of Ser. No. 262,097, Oct. 19, 1988, abandoned, which is a continuation of Ser. No. 52,214, May 15, 1987, abandoned, which is a division of Ser. No. 810,837, Dec. 19, 1985, Pat. No. 4,699,055, which is a continuation of Ser. No. 493,750, May 11, 1983, abandoned.

[30] Foreign Application Priority Data

May 11, 1982 [DE] Fed. Rep. of Germany ..... 3217569

[51] Int. Cl.[5] ..... B41F 31/04; B41F 31/06; B41L 27/06

[52] U.S. Cl. ..... 101/350

[58] Field of Search ..... 101/349, 350, 363, 365, 101/207, 208, 209, 210, 148, 157, 169

[56] References Cited

U.S. PATENT DOCUMENTS

| | | | |
|---|---|---|---|
| 2,359,640 | 10/1944 | Harley | 101/365 |
| 2,377,110 | 5/1945 | Smith | 101/157 |
| 2,645,176 | 7/1953 | Perry | 101/365 |
| 2,823,607 | 2/1958 | Butcher et al. | 101/363 |
| 3,701,335 | 10/1972 | Barnscheidt | 101/350 |
| 4,358,996 | 11/1982 | Ohlsson | 101/350 |

*Primary Examiner*—J. Reed Fisher

*Attorney, Agent, or Firm*—Herbert L. Lerner; Laurence A. Greenberg

[57] ABSTRACT

A method of metering ink in offset printing machines having an ink cylinder with which a metering member adjustable into contact with the ink cylinder with a given pressure is associated, includes varying the contact pressure of the metering member against the ink cylinder as a function of at least one of the viscosity of the ink in a metering gap, the supply of dampening medium and the peripheral speed of the ink cylinder so that a constant specifiable thickness of ink film on the ink cylinder and a constant specifiable intensity of ink impression on the material to be printed is settable, and a device for carrying out the method.

7 Claims, 11 Drawing Sheets

DEVICE FOR METERING INK IN OFFSET PRINTING PRESSES

This is a continuation of application Ser. No. 262,097, filed Oct. 19, 1988, now abandoned, which was a continuation of application Ser. No. 052,214, filed May 15, 1987, now abandoned, which was a divisional of application Ser. No. 810,837, filed Dec. 19, 1985, matured into Pat. No. 4,699,055, issued Oct. 13, 1987, which was a continuation of application Ser. No. 493,750, filed May 11, 1983, now abandoned.

German Published Non-Prosecuted Application (DE-OS) No. 28 12 998 disloses a method and a device for metering a liquid on a roller which is formed as a rubber-covered inking roller and has a diameter greater than the diameter of the plate cylinder. This roller directly inks the printing plate which is clamped onto the plate cylinder. The plate cylinder transfers the printed image in a conventional manner to the blanket cylinder which, in turn, prints the paper web which is supported by a pressure cylinder.

Inking of the inking roller is effected in the aforementioned heretofore known construction by means of an ink supply tank which is located in the region of the outer cylindrical surface of the inking roller. Excess ink is skimmed off the outer cylindrical surface by means of an ink knife to an extent that the ink film left on the other cylindrical surface of the inking roller is of just the correct thickness for the ink zone in question. This ink film is then levelled off by two rollers before being applied to the printing plate. The ink knife which acts as the metering body is, in the foregoing heretofore known construction, pressed against the elastic outer cylindrical surface of the inking roller with such high pressure that the surface of the inking roller is impressed to a considerble degree in the region of the ink knife so that an ink film of the desired slight film thickness can be produced.

In rotary printing presses of this type, in order to stop printing, it is necessary to lift the inking rollers away from the plate cylinder. In the foregoing heretofore known construction, the single inking roller is mounted in a separate frame which is movable by suitable power means. This additional expense and the high accuracy with which the inking roller must be brought into contact with the plate cylinder increase the constructional and financial outlay and reduce the stability of such a printing unit. A further considerable disadvantage of the heretofore known construction is that the steel ink knife presses very deeply into the rubber-covered outer cylindrical surface of the inking roller. Due to the high internal friction of the rubber and the consequently resulting continuous deformation the rubber surface is not completely restored after the point of deformation has passed by the ink knife. The lost work is converted into heat. The elastic properties of the rubber material changes, and the material fatigues rapidly and is soon destroyed.

In the known construction, the inking roller is driven at the peripheral speed of the plate cylinder. The heat generated due to the hard impression of the ink knife, as described hereinafore, leads not only to premature fatigue of the material, but also to a considerable increase in temperature. Because the temperature has a considerble influence on the viscosity of the ink, there is a considerable change in the quantity of ink transferred. In addition, the brief penetration of the ink knife at high speed and the immediately following relaxation produces a natural oscillation in the rubber jacket which leads to changes in the ink gap and thus likewise to inking fluctuations. This oscillation is dependent upon the respective recovery capability of the material and also upon the state of fatigue thereof. Exact, high quality inking of the printing plate is impossible because with the heretofore known construction it is not possible to adjust a reproducible ink uniform quantity i.e. a quantity of ink which is constant under all operating conditions.

It is an object of the invention to provide a method and an ink metering device for implementing the method for producing an absolutely uniform and reproducible ink supply in offset printing machines which ensures, with little expense, exact control of the inking of the plate cylinder.

With the foregoing and other objects in view, there is provided, in accordance with the invention, a method of metering ink in offset printing machines having an ink cylinder with which an adjustable metering member is associated in contact with the ink cylinder with a given pressure which comprises varying the contact pressure of the metering member against the ink cylinder as a function of at least one of the viscosity of the ink in a metering gap, the supply of dampening medium and the peripheral speed of the ink cylinder so that a constant specified thickness of ink film on the ink cylinder and a constant specified intensity of ink impression on the material to be printed is attainable.

In accordance with another mode of the invention, there is provided a method of metering ink in offset printing machines having an ink cylinder with which an adjustable metering member in contact with the ink cylinder at a given pressure, which comprises varying the contact pressure of the metering member against the ink cylinder as a function of at least one of the viscosity of the ink in a metering gap, the supply of dampening medium and the peripheral speed of the ink cylinder so that a constant specific thickness of ink film on the ink cylinder and a constant specific intensity of ink impression on the material to be printed is attainable, and keeping the ink and the ink cylinder at a temperature which is constant at a specified value in a decoupled control circuit independently of the pressure of the ink in the ink metering gap.

In accordance with an additional feature of the invention there is provided a device for metering ink in offset printing machines comprising an ink cylinder having an outer cylindrical surface portion formed of rigid material, at least one metering member extending axially parallel to the ink cylinder and tangentially to the outer cylindrical surface portion thereof, wherein the metering member has a metering surface, and wherein the metering member is carried on a fixed support through an intermediate adjusting element actuated by a pressure medium.

In accordance with a further feature of the invention there is provided a device for metering ink in offset printing machines, comprising an ink cylinder having an outer cylindrical surface portion formed of rigid material, at least one metering member extending axially parallel to the ink cylinder and tangentially to the outer cylindrical surface portion thereof, wherein the metering member has a metering surface, and wherein the metering member is carried on a fixed support through an intermediary adjusting element operated by a pressure medium, and wherein the ink cylinder has at least one chamber connected with a coolant circuit.

In contrast with the prior art construction, the invention of the instant application has the advantage that, with a given pressure of the ink, due to physical laws, the controlling of various parameters results in a constant specified film thickness so that even if there is a change in the hydraulic pressure of the ink, an exact and uniform printed product can be produced. The use of a rigid ink cylinder considerably restricts the number of disturbing factors, such as wear on the outer cylindrical surface of the ink cylinder and inking fluctuations due to the use of a rigid outer cylindrical surface of the ink drum. An ink film is always supplied to the printed product in uniform film thickness, and generally does not require adaptation to or matching of the consumption of ink within different zones over the width of the printed product. In special cases, however, advantageous use can be made of an arrangement wherein the ink metering elements bodies are mounted so as to provide zonewise adaption of the quantity of ink supplied.

In accordance with still another feature of the invention the metering member and the metering surface thereof extends with a constant spacing from and parallel to the longitudinal axis of the ink cylinder.

In accordance with again a further feature of the invention the metering surface of the metering member is spaced at a variable distance from the outer cylindrical surface portion of the ink cylinder.

In accordance with still an additional feature of the invention there is provided a device for metering ink in offset printing machines which comprise an ink cylinder having an outer cylindrical surface portion formed of rigid material, wherein two axially oriented parallel metering members are disposed at opposite locations of the ink cylinder in a common, inherently rigid frame system, and wherein the metering members have a given spacing with respect to the outer cylindrical surface of the ink cylinder, and wherein the spacing corresponds to a desired ink film thickness.

In accordance with again another feature of the invention, there is provided a device for metering ink in offset printing machines comprising an ink cylinder having an outer cylindrical surface portion formed of rigid material, with two metering members disposed at opposite locations of the ink cylinder axially parallel to the inking cylinder and substantially tangentially to the outer cylindrical surface portion thereof, wherein the metering members have respective metering surfaces spaced a given distance from the outer cylindrical surface of the ink cylinder, wherein the spacing corresponds to a desired ink film thickness, and wherein the metering members are mounted on a fixed support through an intermediate adjusting element operated by a pressure medium.

In accordance with still a further feature of the invention the frame system is mounted so as to be able to follow form and location deviations of the ink cylinder.

In accordance with again an additional feature of the invention the frame system embraces the ink cylinder in U-shaped form and has two opposite arms formed with metering surfaces extending substantially tangentially to the outer peripheral surface of the ink cylinder and having a constant spacing axially parallel to the ink cylinder.

In accordance with an added feature of the invention the frame system embraces the ink cylinder in U-shaped form and has two opposite arms and wherein one of the arms defines an ink supply and serves as a metering member with a metering surface, and the opposite arm has a support surface, wherein the metering surface and the support surface are in contact with one outer peripheral surface of said ink cylinder, with the metering surface and the support surface disposed diametrically opposite one another and spaced from one another at a variable distance.

In accordance with again an added feature of the invention the metering and the support surfaces are inclined by a given angle to one another, and the arms are mounted so as to be slidable in direction towards the ink cylinder, and including piston means subjected to pressure medium for sliding the arms.

In accordance with still another feature of the invention at least one metering member is supported on a locally fixed support by means of a multiplicity of mutually adjacent pistons subjected to pressure medium.

In accordance with again an additional feature of the invention there are provided means for adjusting the pressure on the pistons independently of a measured thickness of ink film behind the ink metering gap in a manner that pressure on the pistons is reduced with decreased ink film thickness and increased with increased ink film thickness.

In accordance with again another feature of the invention there are provided means for regulating pressure on the pistons as a function of intensity of ink impression on the material being printed.

In accordance with an added feature of the invention there are provided sensor means for measuring zonewise the thickness of the ink film and means for zonewise regulating pressure on the pistons in accordance with the zonewise measurement of the ink film thickness.

In accordance with again an additional feature of the invention the metering and support surfaces are planar surfaces.

In accordance with still an added feature of the invention the metering surface is a convex surface.

In accordance with still a further feature of the invention a doctor blade is disposed adjacent the ink cylinder and is of cylindrical shape, the doctor blade being driven at a rotary speed which is far lower per unit time than that of the speed of the printing machine and independently of the printing machine.

In accordance with still another feature of the invention there is provided a foil in contact with the inking cylinder, and adjusting elements which are subjected to pressure medium for bracing the foil against the inking cylinder.

In accordance with again a further feature of the invention there is provided a foil disposed adjacent to and movable in peripheral direction of the ink cylinder.

In accordance with a concomitant feature of the invention there is provided a foil, a hose filled with pressure medium bracing the foil on a locally fixed support, and means for attaching the foil to the support.

Due to the foregoing additional features of the invention, the construction of the ink metering device can be simplified, and, consideration can be given to special printing conditions e.g. when working with special inks. Other features which are considered as characteristic for the invention are set forth in the appended claims.

Although the invention is illustrated and described herein as embodied in a method and device for metering ink in offset printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood when read in connection with the accompanying drawings, in which.

Figure 6:
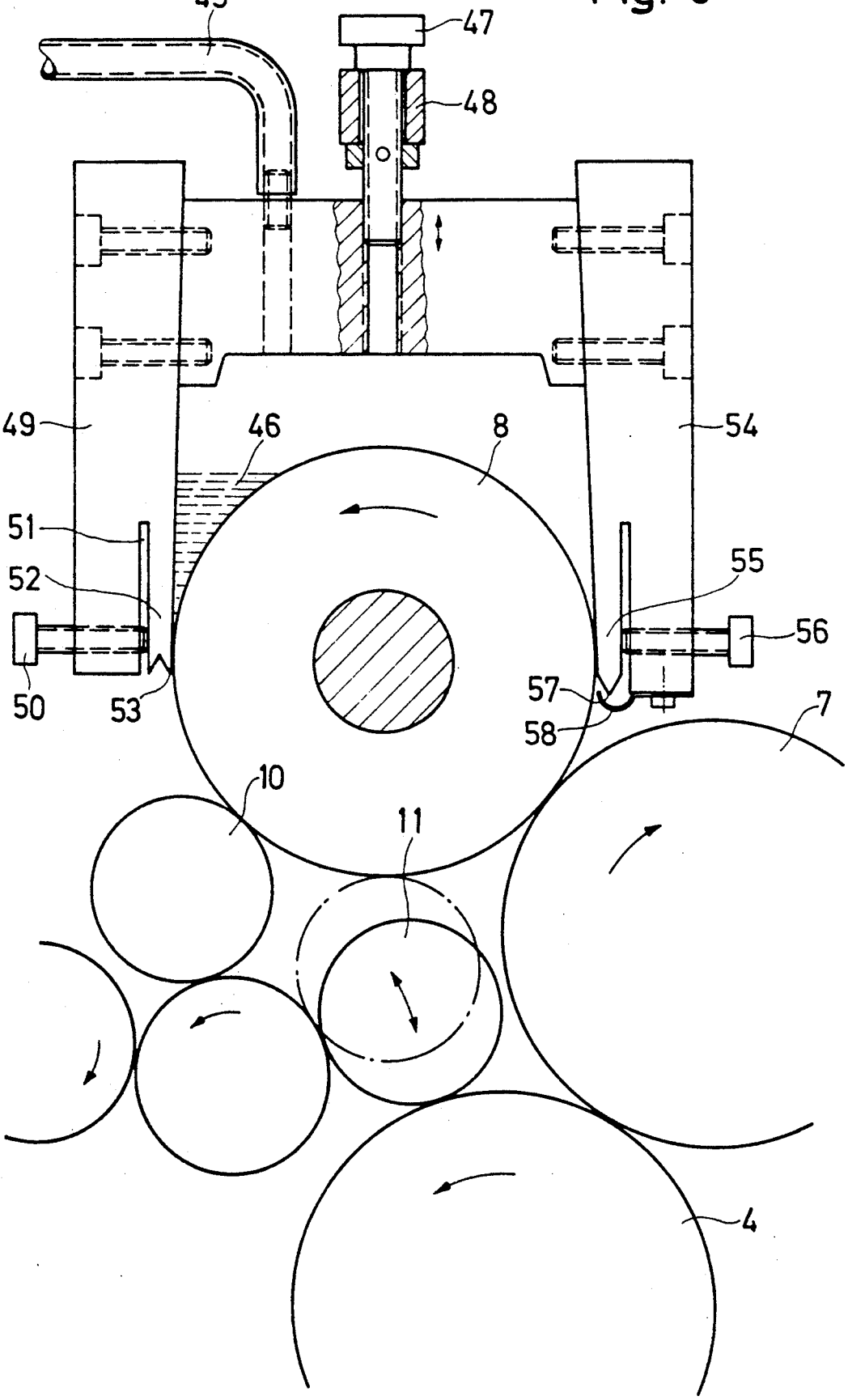
Figure 7:
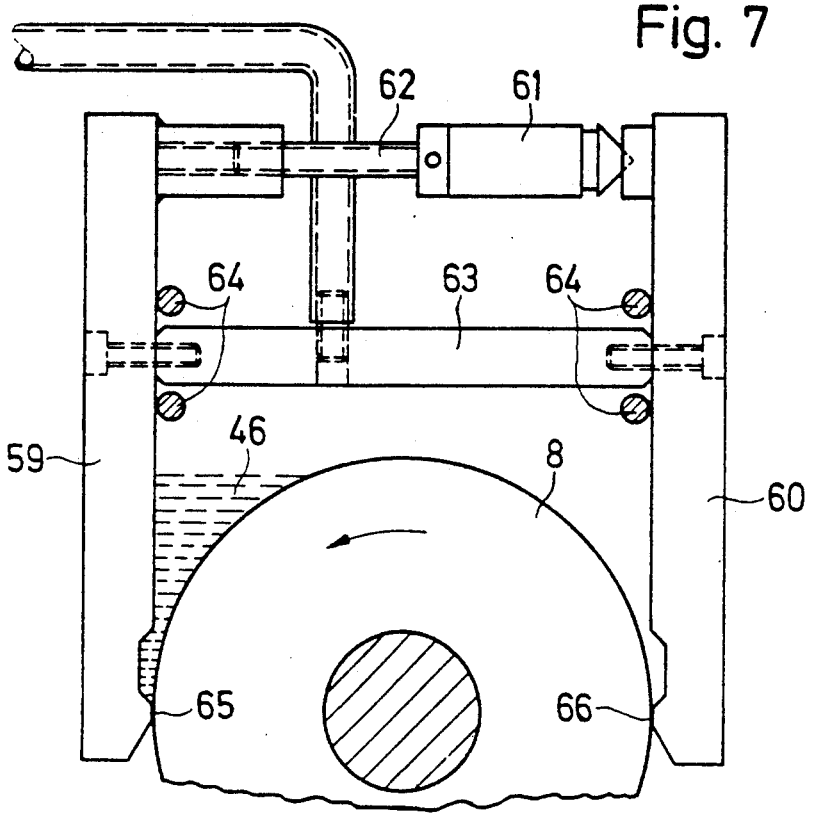
Figure 7A:
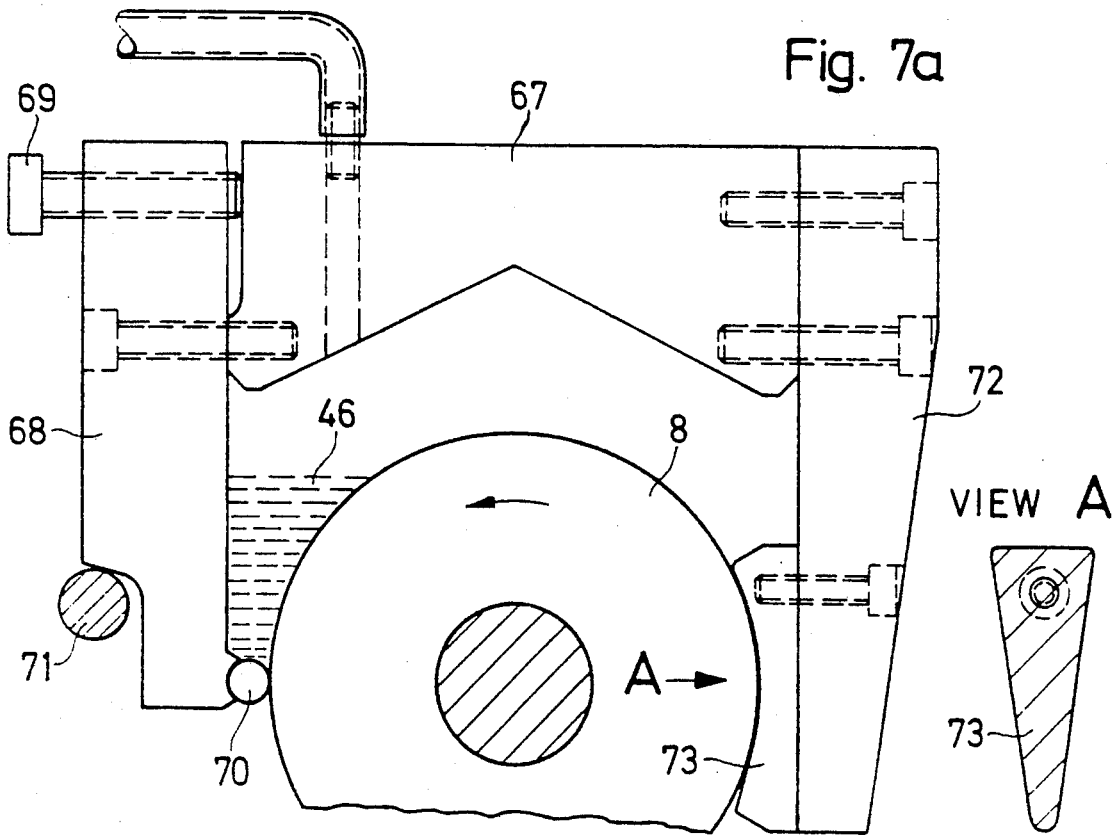
Figure 8:
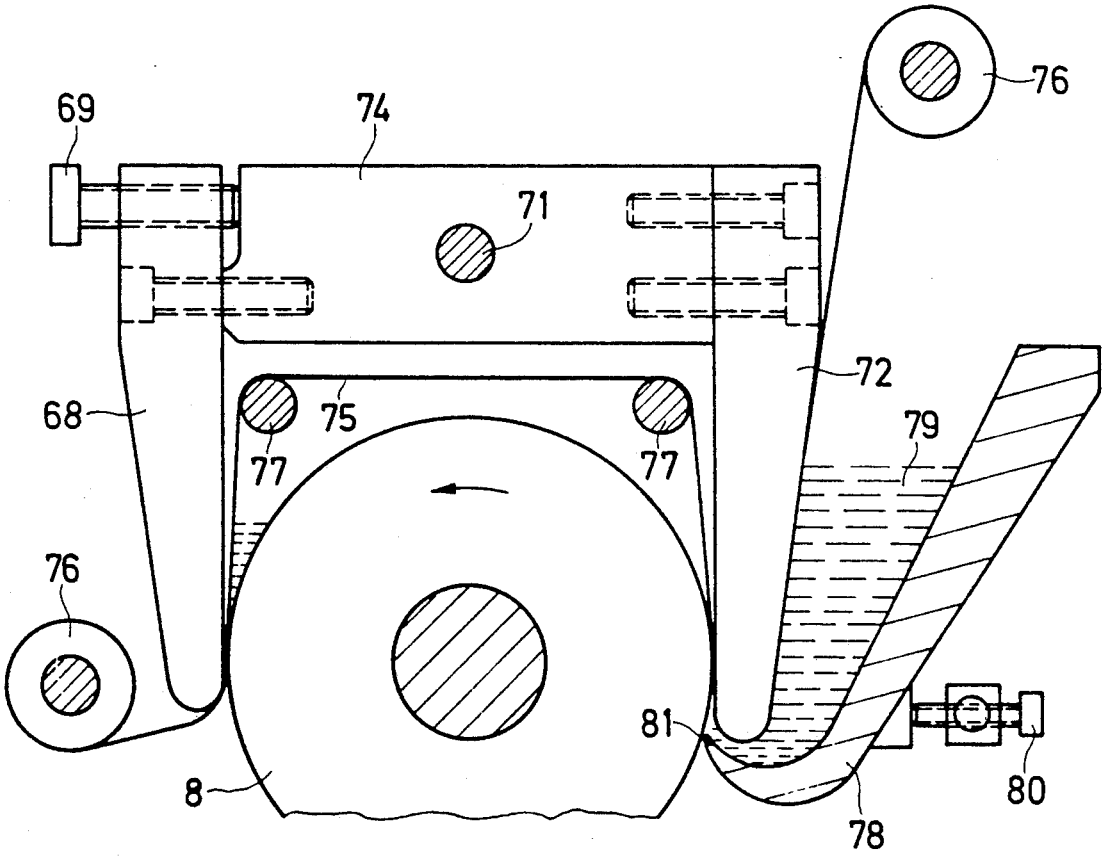
Figure 10:
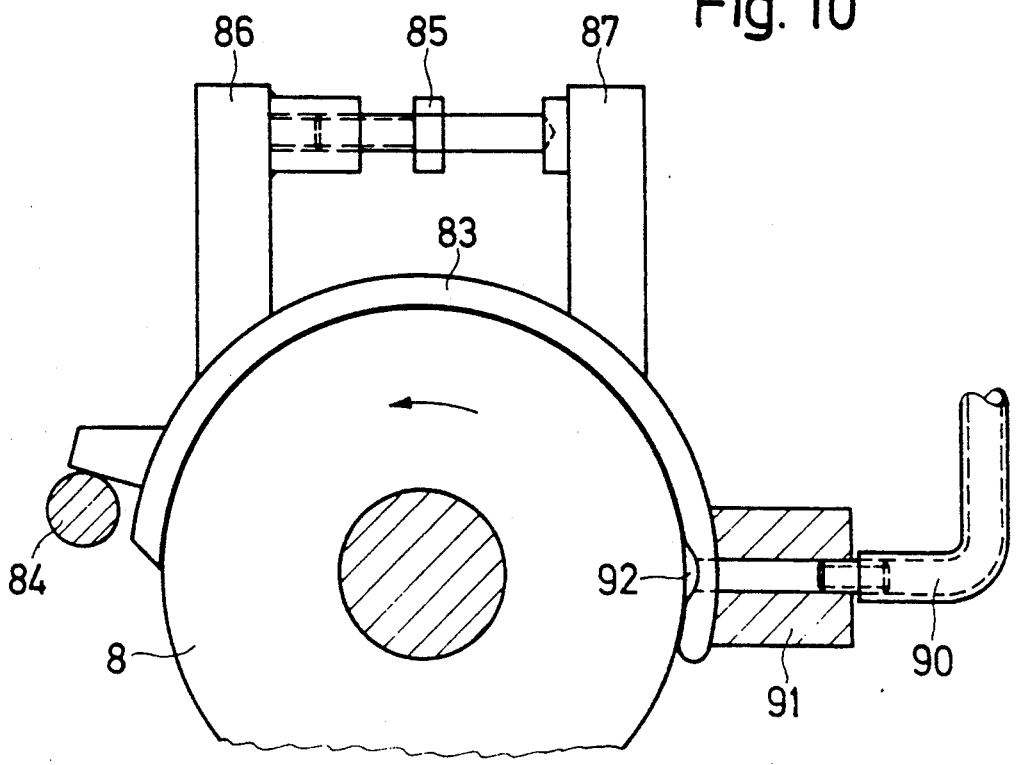
Figure 11:
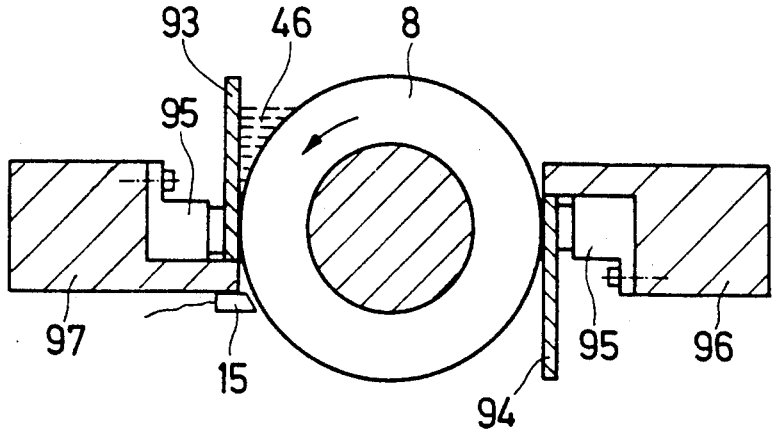
Figure 12:
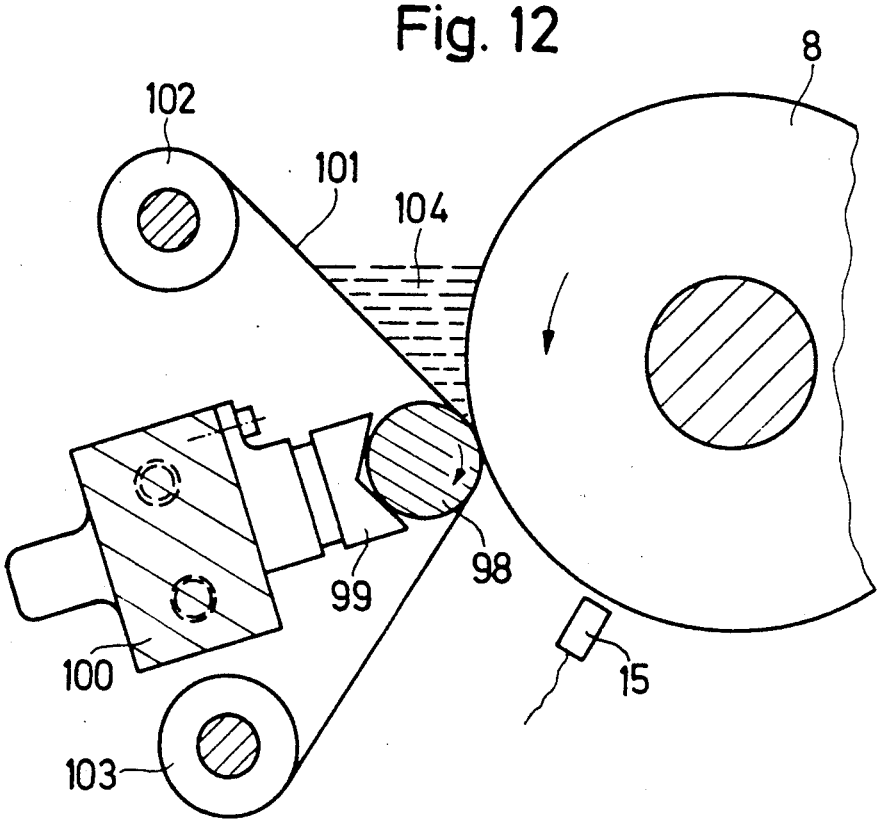
Figure 13:
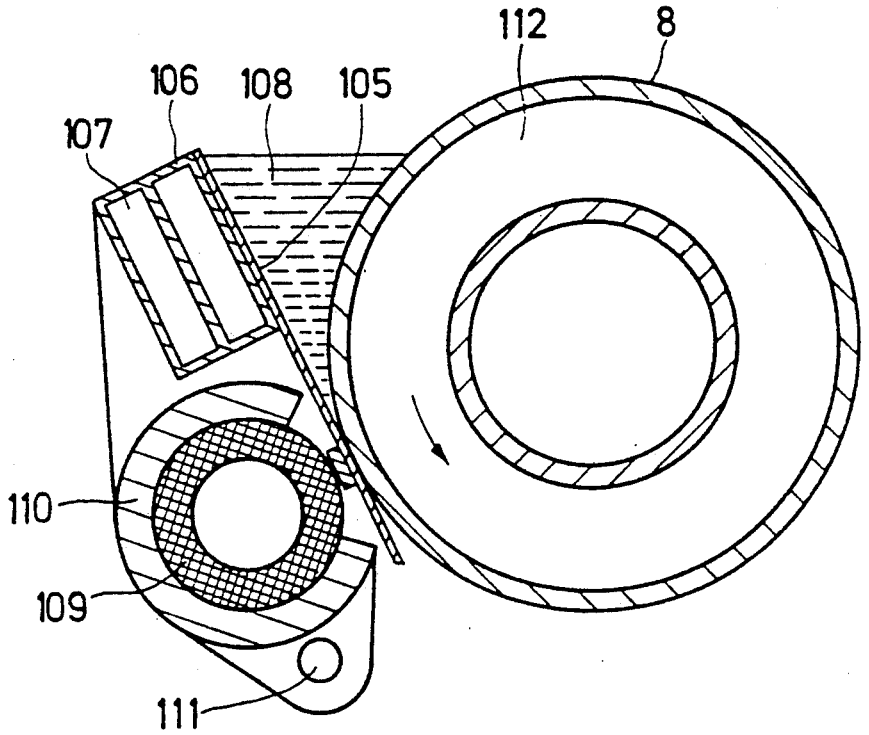
Figure 14:
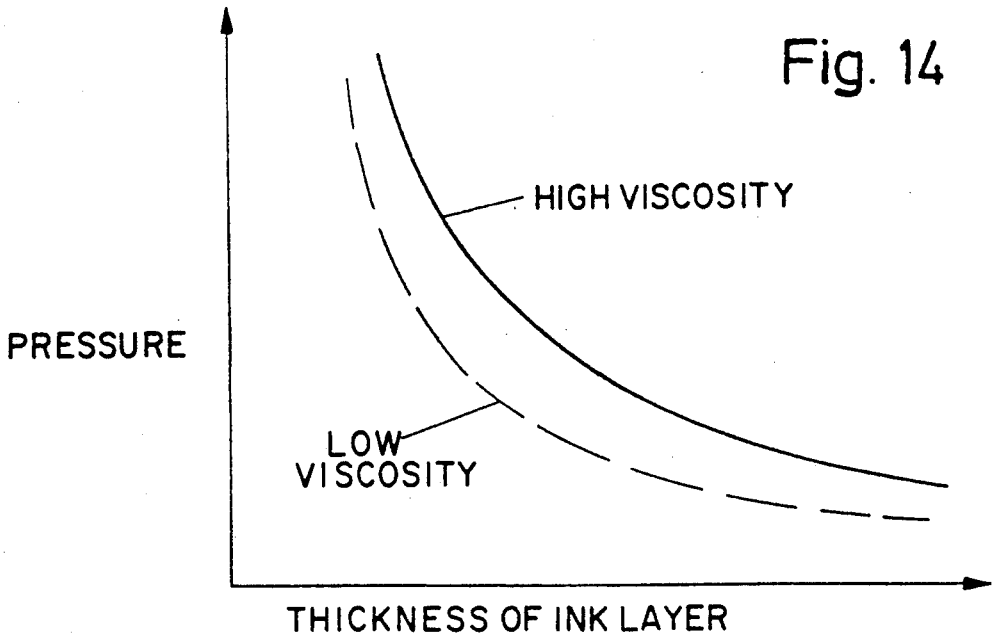

FIGS. 5, 6, 7, 7*a*, 8, 9, 10, 11, 12 and 13 are enlarged side elevational views of various different embodiments of the ink metering device of the invention, the embodiments of FIGS. 8 and 12 having a foil covering, and the embodiment of FIG. 13 having pneumatic engagement or contact; and FIG. 14 is a plot diagram of the specific contact force (N/mm) for given ink-layer thicknesses.

Figure 1:
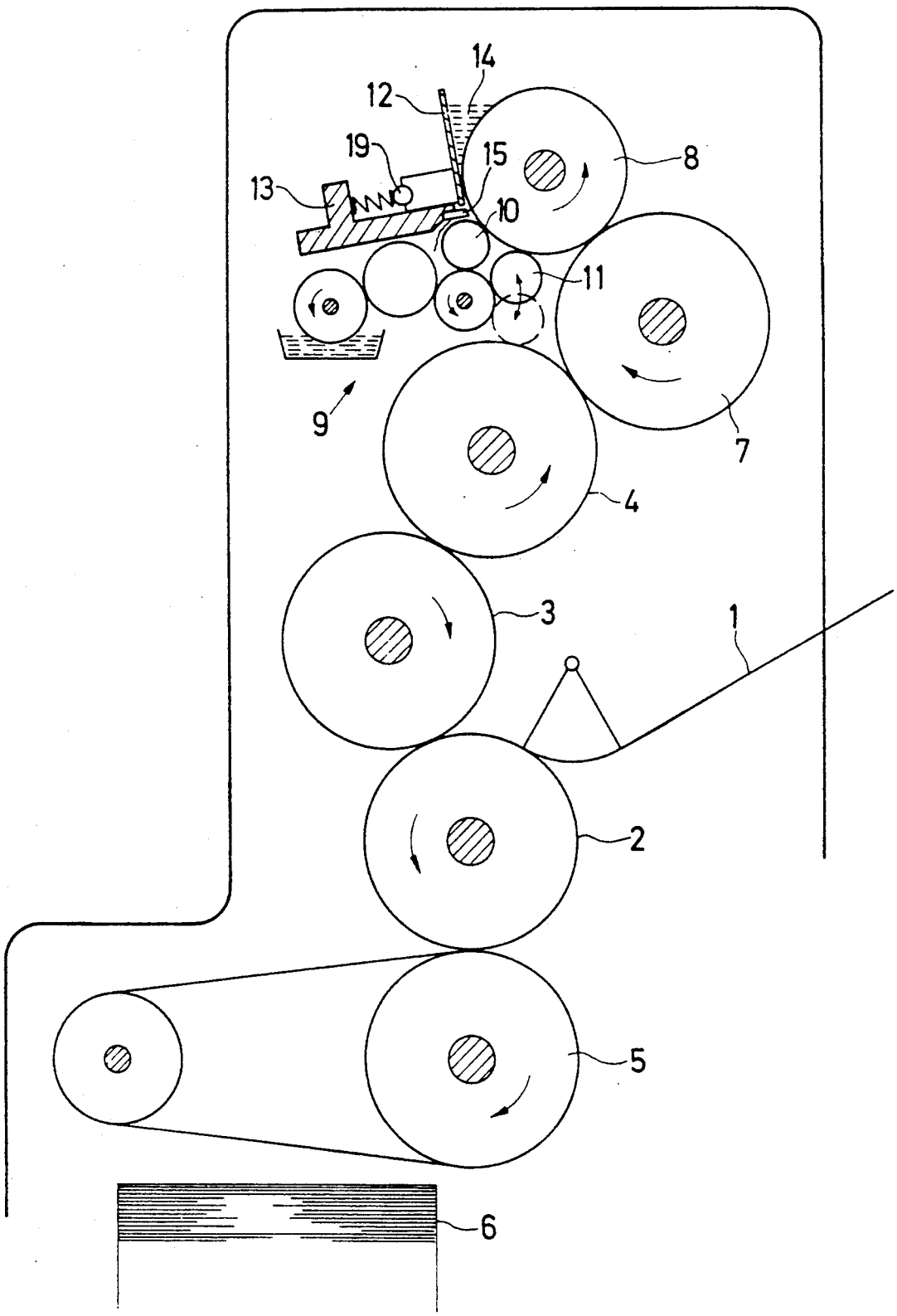
FIG. 1 is a diagrammatic side elevational view of an offset printing unit with an ink metering device.

Referring now to the drawing and first, particularly, to FIG. 1 thereof, there is shown in diagrammatic form an offset printing press wherein, in conventional manner, the sheets being printed are fed via a feeder 1 to a printing cylinder 2 which cooperates with a rubber-covered blanket cylinder 3 and a plate cylinder 4. The printed image is thus transferred from the plate cylinder 4 via the blanket cylinder 3 onto the sheet being printed on the printing cylinder 2. After printing, the sheet is fed by a chain delivery 5 to a delivery stack 6.

Associated with the plate cylinder 4 is an inking cylinder 7 having an elastic outer cylindrical surface and preferably having the same diameter as that of the plate cylinder 4. The inking cylinder 7, in turn, receives ink from an ink cylinder 8 which is provided with an outer cylindrical surface formed of rigid material e.g. metal. A dampening unit 9 transmits dampening medium via two applicator rollers 10 and 11 onto the ink cylinder 8, with the applicator 11 located in the last mentioned position as viewed in direction of rotation being mounted so as to be pivotable into contact with the plate cylinder 4 into the position 11' of shown in broken lines, in order to effect faster dampening.

Associated with the ink cylinder 8 is a metering body 12 which, by means of compression springs having a constant spring characteristic and by means of ball joints 19 is supported on a cross-member 13 which is fastened to the side frames. An ink supply 14 is located in a gap between the ink cylinder 8 and the metering body 12. As viewed in direction of rotation of the ink cylinder 8, sensors 15 which measure the film thickness of ink on the ink cylinder 8 are disposed beneath the metering body 12.

Figure 2:
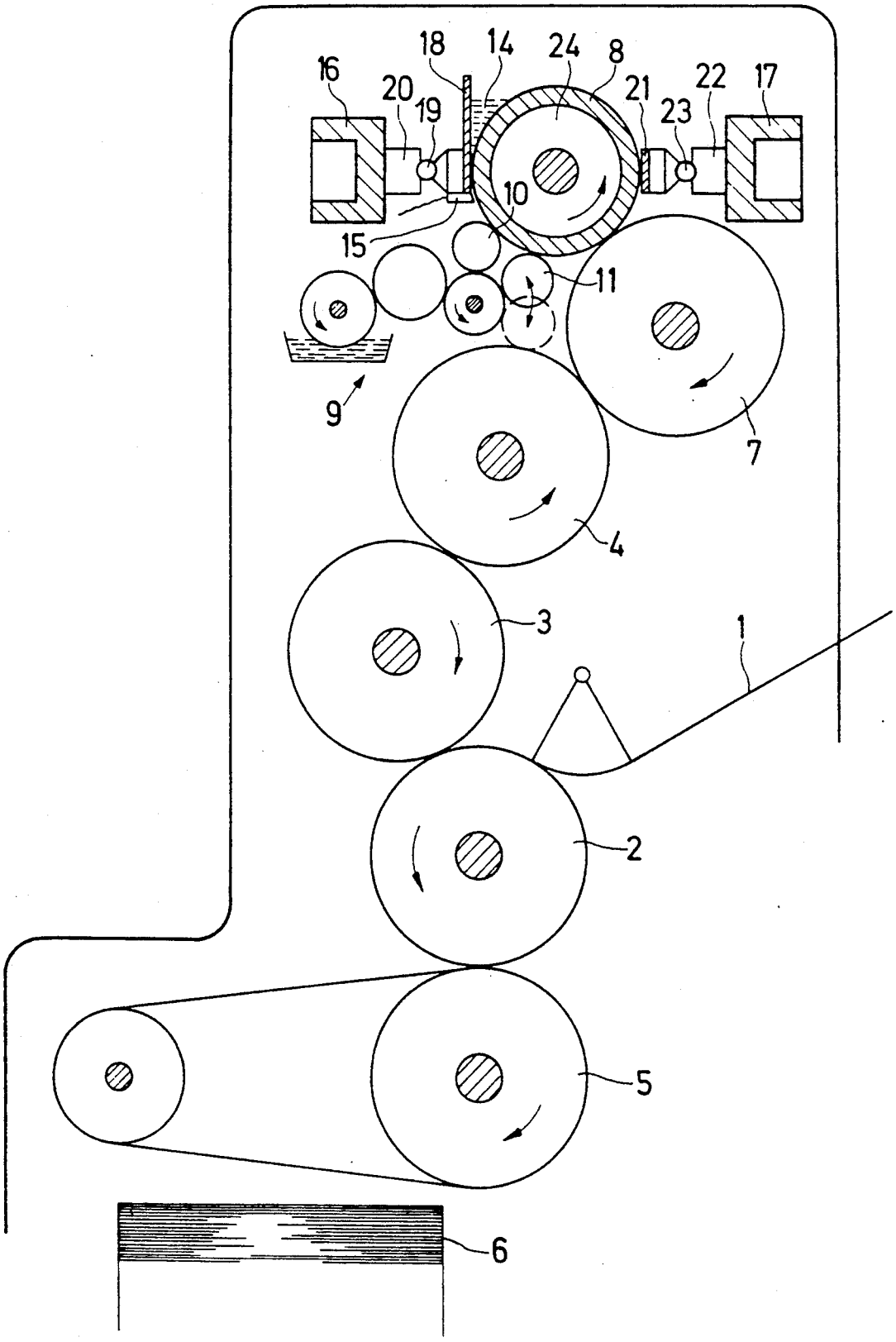
FIG. 2 is a view similar to that of FIG. 1 of the offset printing unit with a different embodiment of the ink metering device.

The embodiment shown in FIG. 2 differs from that of FIG. 1 in that cross-members 16 and 17, respectively, are provided on both sides of the ink drum 8. A metering body 18 is braced against the cross-member 16 by ball joints 19 and pressure-medium cylinders 20, with only one of each being shown in FIG. 2. The pressure-medium cylinders 20 with the ball joints 19 are disposed closely juxtaposed along the length of the ink cylinder 8 so that, if the pressure-medium cylinders 20 are uniformly actuated, a uniformly distributed contact pressure is provided over the entire width of the ink cylinder 8. The level of actuation of the cylinders is controlled as a function of the viscosity of the ink in the metering gap and/or the supply of dampening solution and/or the peripheral speed of the ink cylinder in such a manner that a constant thickness of the ink film on the ink cylinder 8 and a constant density of the ink impression on the material being printed, are provided. The thickness of the ink film can be precisely measured by the sensors 15 which are assigned to the different ink zones. Zonewise control of the film thickness is possible, if necessary or desirable, by means of individually applied actuation of the pressure-medium cylinders 20.

Braced against the cross-member 17 is a support body 21 which is likewise brought into zonewise contact by pressure-medium cylinders 22 via ball joints 23. Each pressure-medium cylinder 22 can therefore exert the same pressure as the opposite pressure-medium cylinder 20 so that the pressure forces acting on the ink cylinder 8 are cancelled out. Bending of the ink cylinder 8 is thereby reliably prevented.

In the illustrated embodiment of FIG. 2, the ink cylinder 8 has a chamber 24 which may be filled with a cooling liquid. Assurance is thereby provided that the temperature of the ink and of the ink cylinder 8 are kept constant in the metering gap at a given value in a decoupled control loop independent of the pressure of the ink.

Figure 3:
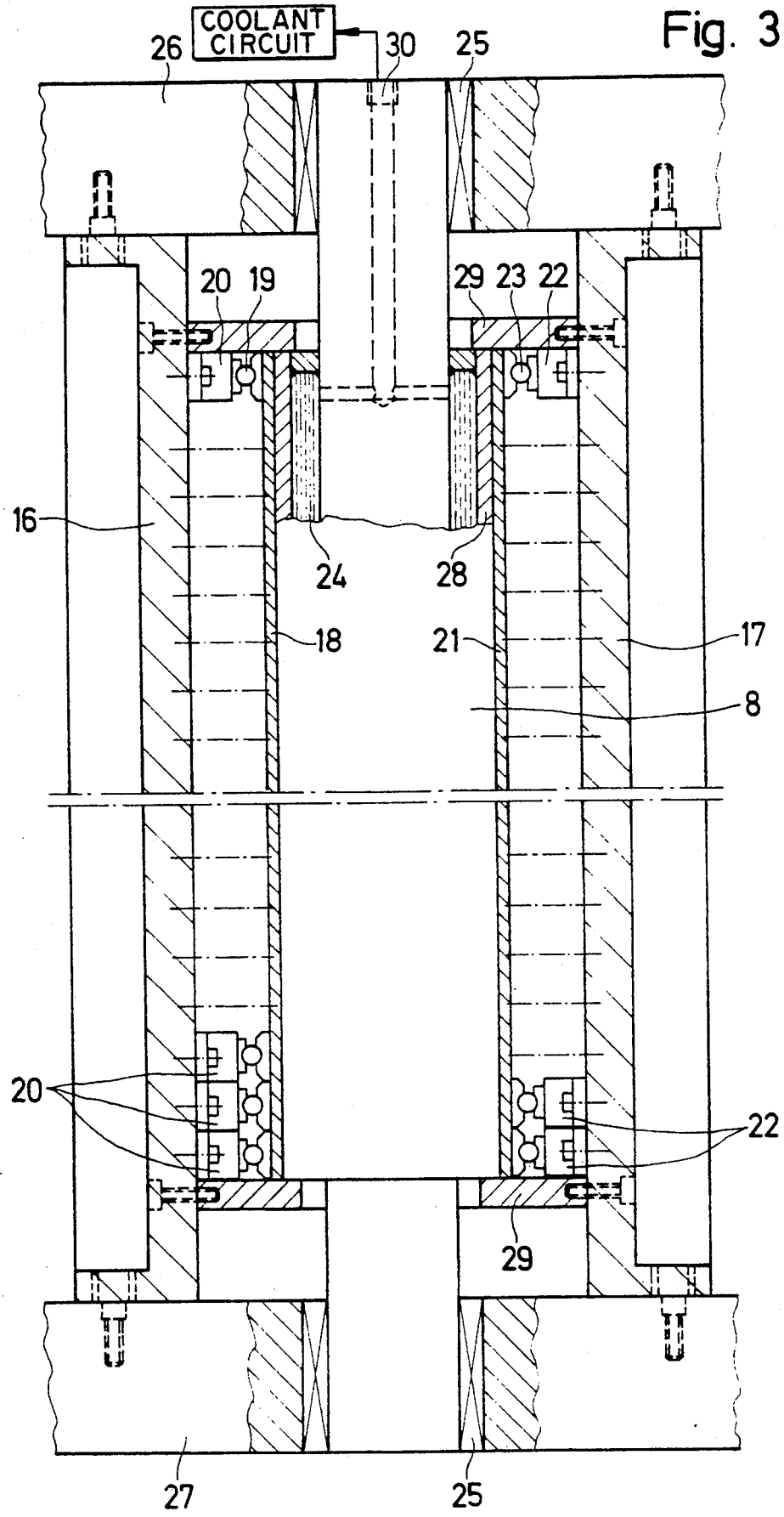
FIG. 3 is a considerably enlarged, partly broken away longitudinal sectional view of FIG. 2 showing the ink metering device thereof.

FIG. 3 shows, in longitudinal sectional view, an ink metering device forming part of the overall embodiment of FIG. 2, with the ink metering device including the ink cylinder 8 mounted by means of roller bearings 25 in side frames 26 and 27 of the printing machine. The outer cylindrical surface portion 28 of the ink cylinder 8 is made of metal and is in contact at the end faces thereof with sealing jaws 29 for the ink. The sealing jaws 29, in turn, are fastened to the cross-members 16 and 17. The chamber 24 is connected through a bore 30 to a non-illustrated coolant circuit.

Figure 4:
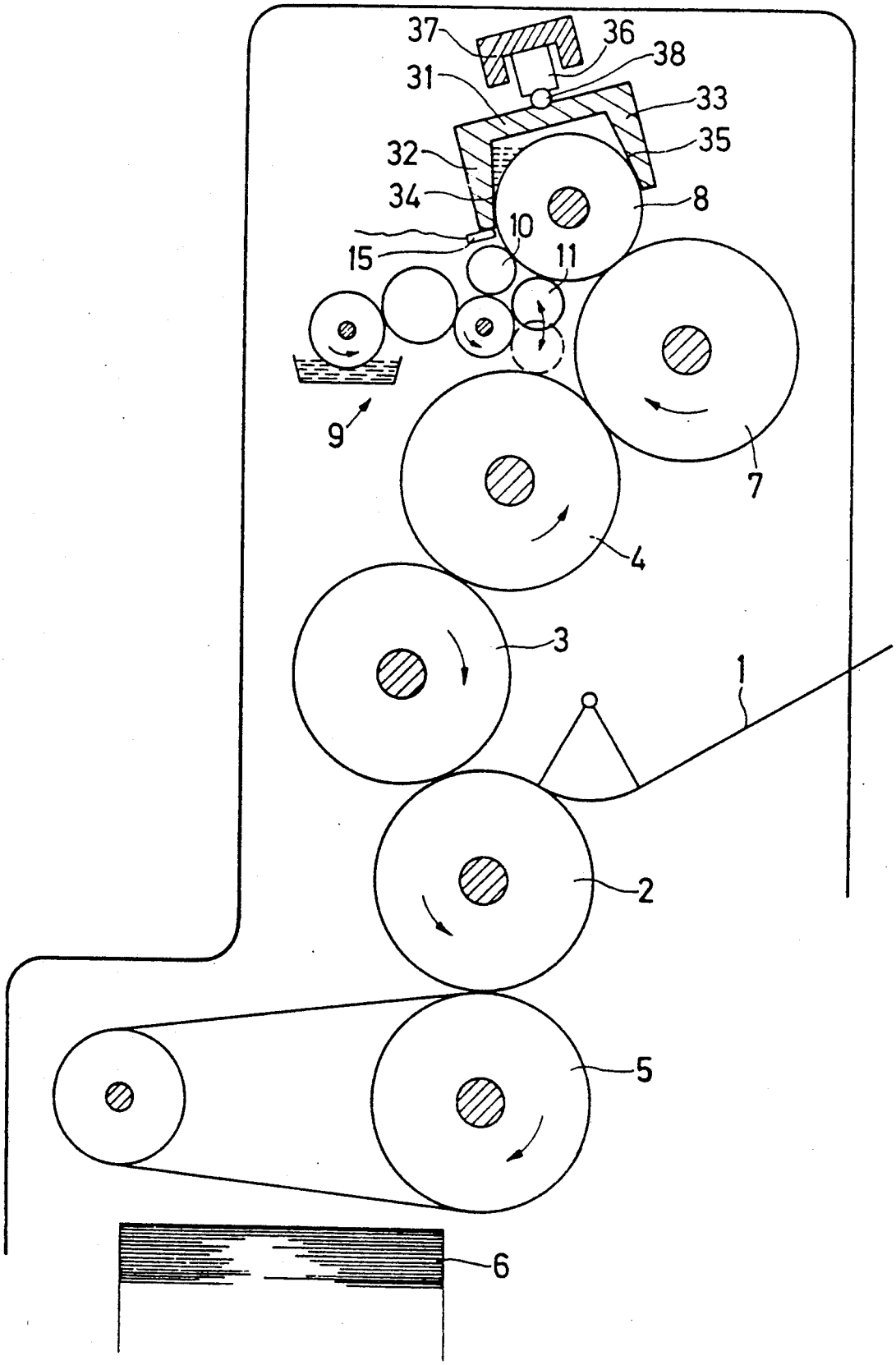
FIG. 4 is another view similar to that of FIG. 1 of an offset printing unit with a third embodiment of the ink metering device.

The embodiment of the ink metering device according to FIG. 4 differs in that a U-shaped metering body 31 having two arms 32 and 33 embracing the ink cylinder 8 is provided parallel to the longitudinal axis of the ink cylinder 8. The metering surface 34 on the arm 32 as well as the support surface 35 on the arm 33 are in tangential contact with the outer cylindrical surface of the ink cylinder 8. The metering surface 34 and the support surface 35 are slightly inclined with respect to one another, but are precisely parallel to one another in longitudinal direction thereof. By means of pressure cylinders 36 subjected to pressure medium and supported on a cross-member 37 mounted in the side frames of the printing machine, it is possible to move the metering body 31 by means of ball joints 38 towards and away from the ink cylinder 8. Due to the inclined constructin of the metering surface 34 and of the support surface 35 is it thus possible, by radially moving the metering body e.g. towards the outer cylindrical surface of the ink cylinder 8, to reduce the ink gap so that a smaller quantity of ink is fed to the plate cylinder 4. This embodiment which effects pressure equalization in a simple manner may be employed advantageously on narrow printing presses. The necessary clearance precision and parallelism, respectively, of the arms 32 and 33 are attainable at low costs.

Figure 5:
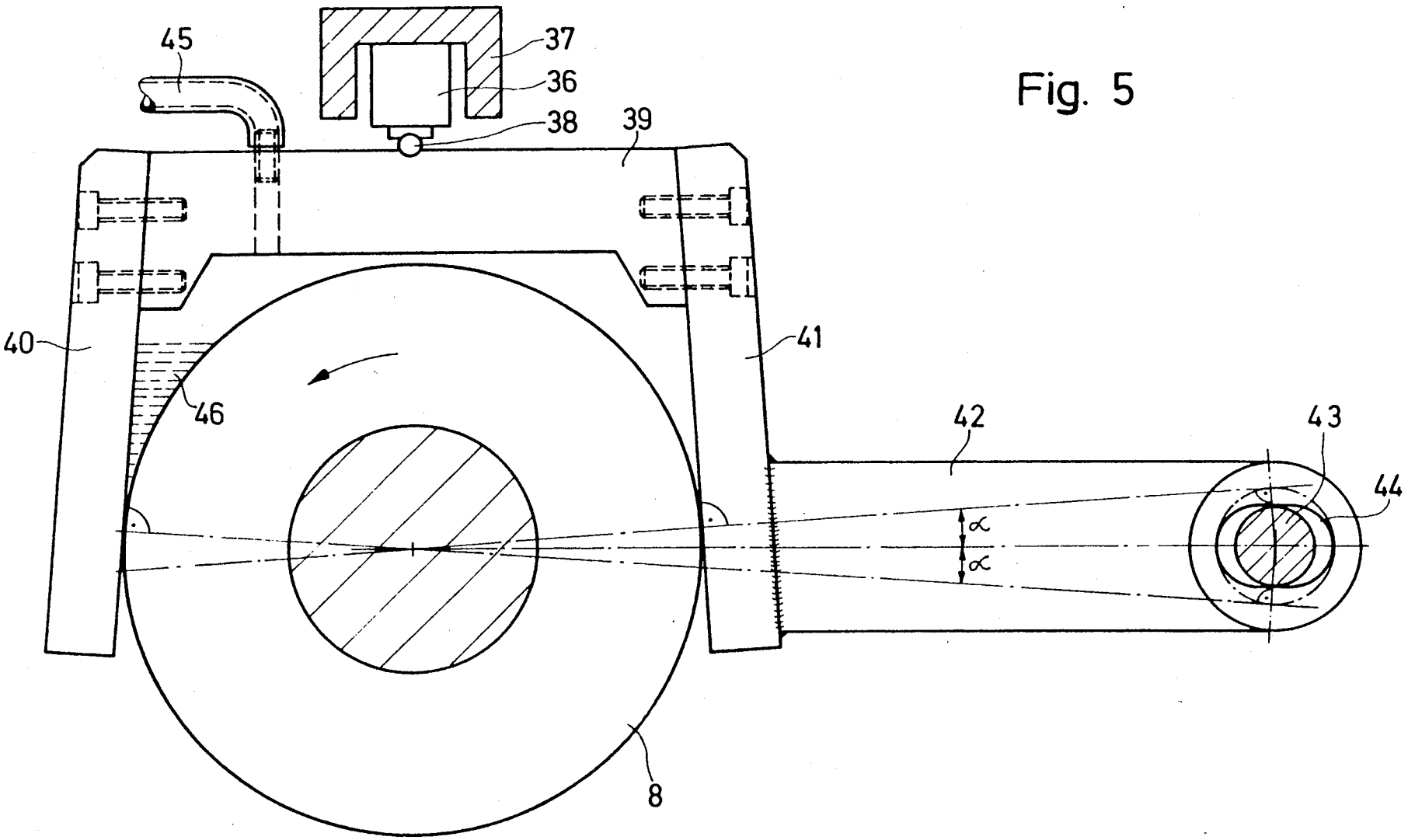

The construction of the ink metering device according to FIG. 5 includes a bridge part 39, a metering plate 40 and a support plate 41 which are guided at opposite ends by lever arms 42 on a guide rod 43. In order to permit alignment of the support plate 41 on the ink cylinder 8, a slot 44 for the guide rod 43 is provided in the lever arm 42.

Via a pipe 45, the ink supply 46 can be replenished between the metering plate 40 and the ink cylinder 8. In this embodiment, too, a pressure cylinder 36 subjected to pressure medium is supported on a cross-member 37 and, via a ball joint 38, moves the metering plate 40 and the support plate 41 to a greater or lesser extend against the outer cylindrical surface of the ink cylinder 8. The ink metering device can, in this case, follow the positional deviations of the ink cylinder 8. Due to the arrangement of the metering plate 40 at an inclination with respect to the support plate 41 at inclination angles $\alpha$, and due to the changing of the contact pressure, the thickness of the ink gap can be varied and, thus, the quantity of ink fed to the plate cylinder 4 not shown in FIG. 5 is varied accordingly.

The embodiment of the ink metering device according to FIG. 6 differs from that of FIG. 5 in that the adjustment is effected manually by means of adjusting screws 47 which are disposed in a fixed cross-member 48. By turning the adjusting screw 47 it is possible to adjust the ink metering device in the described manner with respect to the ink cylinder 8. A further difference is that regulating screws 50 are provided on a zonewise basis in the metering plate 49 and act upon a lug 52 formed by providing an elongated slit 51 in the metering plate 49. By means of these regulating screws 50 and the lugs 52, it is possibe to perform a basic ajustment, e.g. for compensating production tolerances. Likewise, it is possible to regulate the ink quantity zonewise individually, at the end of the lug, as viewed in the direction of rotation, by means of a skimming edge 53 which prevents ink from collecting and dripping off. On the side opposite the metering plate 49, a support place 54 is provided on which a similar lug 55 is adjustable by means of adjusting screws 56 is likewise provided. On the lug 55, a drip-off edge 57 from which ink can drip off into channel 58 is provided.

In the embodiment shown in FIG. 7, in contrast with the previously described embodiments, the adjustment of the metering plate 59 with respect to the support plate 60 is performed by providing, in an upper part of the support plate 60, a turn-buckle 61 which, via a threaded spindle 62, assures regulation of the position of the two plates 59 and 60 with respect to one another. An elastic spacer plate 63 forms the pivot point and simultaneously serves for holding the ink metering device by means of bearing bolts 64 which are fastened on opposite sides in the machine frames. The adjustment by means of a turnbuckle 61 assures the setting of the ink gap between the metering plate 59 and ink cylinder 8 with great accuracy. In a modification of the embodiment of FIG. 7, the metering surface 65 and the support surface 66 are of narrow construction without causing any adverse effect upon the operation of the ink metering device.

In the embodiment shown in FIG. *7a*, a bridge 67 serves as pivot point for the metering plate 68. For regulation, the screws 69 are turned so that the metering body 70 of circular cross-section is moved towards or away from the outer clyindrical surface of the ink cylinder 8. Bearing bolts 71 fastened in the side frames prevent the ink metering device from turning. In the illustrated embodiment of FIG. *7a*, the opposite support plate 72 is provided with several guide shoes 73 between which the ink on the outer cylindrical surface of the ink cylinder 8 can be guided back into the ink supply 46. The cross section of the guide shoes is tapered as viewed in direction of the arrow A, as shown.

The embodiment shown in FIG. 8 differs from that in FIG. *7a* in that bearing bolts 71 engage the bridge 74 directly. To prevent any wear and to eliminate any collecting dirt particles, there is in this embodiment a foil 75 which can be wound onto the rollers 76. It is merely necessary to turn one of the two rollers 76 slightly further, preferably the roller for winding up the soiled foil 75, and then a new section of the foil 75 is in the region of the metering surfaces. Within the ink metering device, there are deflection rollers 77 which prevent the foil from lying on the ink cylinder 8. The ink feed, in the illustrated embodiment of FIG. 8, is effected via a separate channel 78 wherein a supply of fresh ink 79 is located. By means of an adjusting screw 80, it is possible to adjust the channel towards the outer cylindrical surface of the ink cylinder 8. The rotational motion of the ink cylinder 8 meters the ink between the outer cylindrical surface of the ink cylinder 8 and the foil 75 beforehand in the region of the support plate 72 and uniformly distributes the ink which is fed into the vicinity of the metering plate 68. In this case, also, the quantity of ink fed to the plate cylinder can be regulated very finely by means of the screws 69.

Figure 9:
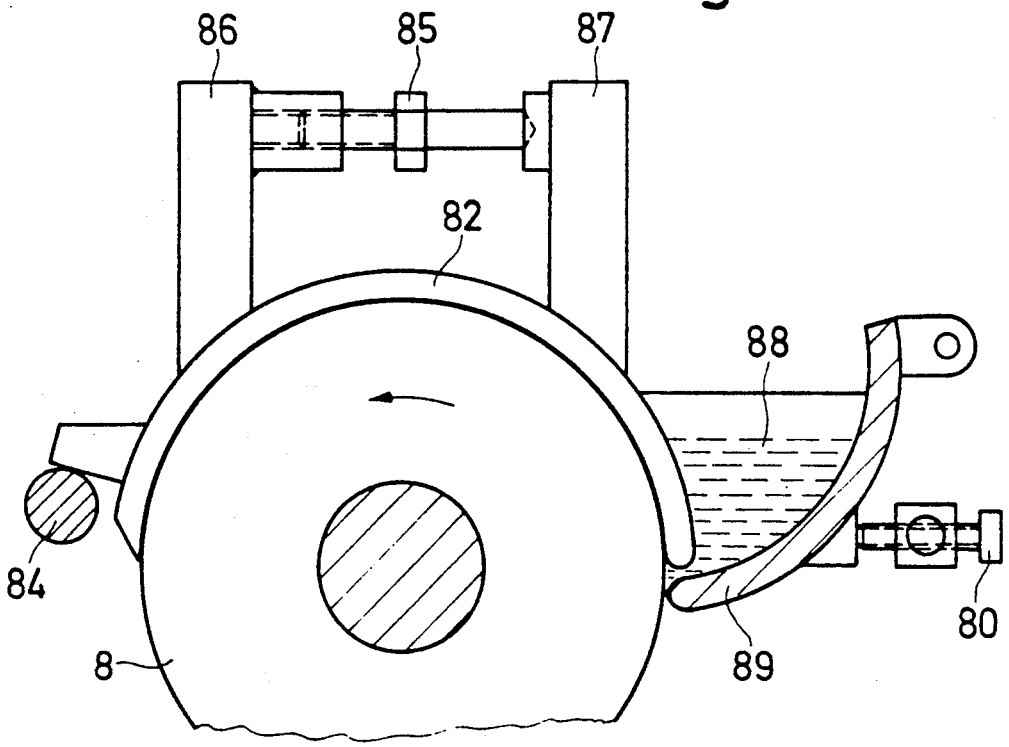

The embodiments in FIG. 9 and FIG. 10 differ from that of FIG. 8 in that skimming or stripping members 82 and 83 are provided, which are convex in shape and are supported on bolts 84. By turning adjusting screws 85 between two arms 86 and 87 , it possible to change the convex form of the skimming or stripping member 82, 83 slightly so that is thereby also possible to achieve accurate regulation of the ink feed. The ink 88 is fed, in the embodiment of FIG. 9, through a pan 89 which, likewise, can be adjusted with respect to the ink cylinder 8 by means of an adjusting screw 80. In FIG. 10, the ink supply pipe 90 is fastened to a distributor beam 91.

In the embodiment of FIG. 11, a metering plate 93 and a support plate 94 are likewise associated with the ink cylinder 8. Both plates 93 and 94 are supported on fixed cross-members 97 and 96, respectively, by means of pressure cylinders 95 subjected to pressure medium. Due to the precise opposite dispostion of the zonewise disposed pistons 95 subjected to pressure medium, the two pressure cylinders which are, respectively, opposite one another can be connected in parallel to a pressure-medium supply line so that the opposing pressure of both pistons is absolutely identical and is therefore self-cancelling so that there are no one-sided or unbalanced forces acting on the ink cylinder 8. The doctor blades 94 and 93 are flexible and can bend. The pressure cylinder pairs 95 subjected to pressure medium, which are uniformly distributed over the width, and are of identical dimensions and are subjected to the same pressure so that an ink gap of the same spacing is formed along the width irrespective of local deviations in form or position. This embodiment is particularly well suited to relatively wide printing presses.

The embodiment of FIG. 12 shows a cylindrical skimming and stripping member 98 which is supported by pressure cylinders 99 subjected to pressure medium and located on a fixed cross-member 100. The skimming and stripping member 98 is driven by a non-illustrated drive, of which the rotational speed per unit time is very low (a few revolutions per second) irrespective of the printing-press speed. Also driven at precisely this speed is the elastic roller-wide foil 101 which, in the illustrated embodiment of FIG. 12, is wound from a pay-out roller 102 over the skimming and stripping member 98 back onto a wind-up roller 103. In the same manner, it is also possible to use an endlessly rotating foil. An ink supply 104 is located between an upper arm 101 of the sheet and the outer cylindrical surface of the ink cylinder 8. In this embodiment it is not possible for dirt particles or dried ink residue to stick so that precise regulation of the ink quantity is possible.

The embodiment of FIG. 13 differs from the preceding embodiments in that an ink knife 105 is provided which is in tangential contact with the ink cylinder 8 and which is attached to a cross-member 106 which can hold coolant in a chamber 107 for cooling the ink supply 108. In the region of the point of contact between the ink knife 105 and the ink cylinder 8, there is a pressure hose 109 which is supported in a pipe segment 110. Both the pipe segment 110 with the pressure hose 109 as well as the cross-member 106 with the ink knife 105 can be swung down away by means of a pivot point 111. If, in the engaged position, a pressure medium is introduced into the pressure hose 109, the latter expands to a greater or lesser extend outwardly and presses the ink knife 105 against the outer cylindrical surface of the ink cylinder 8. This permits the ink gap and thus the ink feed quantity to be accurately metered. Furthermore, with this embodiment, a coolant 112 can be introduced into the ink cylinder 8.

In the embodiment of FIG. 13, the ink knife 105 can also be in the form of a rigid foil which is fastened to the locally fixed bearing or support 106 and is supported by means of the hose 109 which is filled with pressure medium. This has the advantage that, in the case of damage or wear to the foil, the latter can easily be replaced since it is fastened, for example, by bonding to the cross member 106.

FIG. 14 shows a plot diagram wherein the relationships between ink film thickness and specific contact pressure for different viscosity of the ink are represented. It can clearly be seen that, in the case of an ink with low viscosity and with the same contact force there is a smaller ink film thickness on the ink cylinder 8. The cooling system provided, makes it possible, however, to keep the viscosity of the ink constant within narrow limits.

I claim:

1. Device for metering ink in offset printing machines comprising an ink cylinder having an outer cylindrical surface portion formed of rigid material, an inking cylinder in contact with said ink cylinder, at least one U-shaped metering body having a U-shaped cross-section having two arms, said metering body being parallel to said ink cylinder, said arms forming two substantially oppositely facing metering surfaces tangentially engaging said ink cylinder surface at substantially diametrically opposite lines of engagement, said metering surfaces forming an acute angle having an apex pointing away from said inking cylinder, and wherein said ink cylinder and said inking cylinder have opposite direction of rotation, an ink well disposed between the surface of the ink cylinder and at least one of said metering surfaces, said metering body being carried on a fixed support through the intermediary of an adjusting element subjected to a pressure medium, one of said metering surfaces extending with a constant spacing from an parallel to the longitudinal axis of said ink cylinder.

2. Device for metering ink in offset printing machines according to claim 1, wherein said constant spacing forms an ink gap of given thickness.

3. Device for metering ink in offset printing machines comprising an ink cylinder having an outer cylindrical surface portion formed of rigid material, an inking cylinder in contact with said ink cylinder, two metering members is disposed at oppostie locations of said ink cylinder parallel to said inking cylinder and tangentially to the outer cylindrical surfaces portion thereof, said metering members having respective metering surfaces spaced a given distance from the outer cylindrical surface portion of said ink cylinder, said spacing corresponding to a desired ink gap thickness, said metering members being carried on a fixed support through the intermediary of an adjusting element subjected to a pressure medium said metering surfaces forming an acute angle having an apex pointing away from said inking cylinder, and wherein said ink cylinder and said inking cylinder have opposite directions of rotation.

4. Device according to claim 3 wherein said fixed support is mounted so as to be able to follow form and location deviations of said ink cylinder.

5. Device according to claim 3 wherein said fixed support embraces said ink cylinder in U-shaped form and has two opposite arms wherein said metering surfaces are disposed on facing surfaces of said arms.

6. Device according to claim 5 wherein said metering surfaces are planar surfaces.

7. Device for metering ink in offset printing machines, comprising an ink cylinder having an outer cylindrical surfaces formed of a rigid material, an inking cylinder in contact with said ink cylinder, an elongate metering body being parallel with the ink cylinder, having a cross-section shaped like a "U" having two arms forming respectively a metering surface and a support surface, said surfaces tangentially engaging the ink cylinder at respective lines of engagement that are parallel with the ink cylinder, said metering surface having a given spacing from the surface of the ink cylinder forming an ink gap parallel with the ink cylinder, said metering surface and said support surface forming an acute angle having an apex facing away from said inking cylinder, means for slidably urging said metering body in direction to the ink cylinder, and a rigid elongate cross member for supporting the metering body and applying a given force thereto, and wherein said ink cylinder and said inking cylinder have opposite direction of rotation.

* * * * *